United States Patent [19]

Moses

[11] Patent Number: 4,553,256

[45] Date of Patent: Nov. 12, 1985

[54] APPARATUS AND METHOD FOR PLASMA GENERATION OF X-RAY BURSTS

[76] Inventor: Kenneth G. Moses, 6330 Sattes Dr., Rancho Palos Verdes, Calif. 90274

[21] Appl. No.: 449,255

[22] Filed: Dec. 13, 1982

[51] Int. Cl.[4] ..... H01J 3/02; H01J 35/30

[52] U.S. Cl. ..... 378/137; 315/111.41; 378/119

[58] Field of Search ..... 378/138, 119, 137; 315/111.71, 111.41, 111.61, 111.81; 376/132, 134

[56] References Cited

U.S. PATENT DOCUMENTS

| | | | |
|---|---|---|---|
| 2,533,859 | 12/1950 | Wideröe | 378/138 |
| 3,040,209 | 6/1962 | Mack | 315/111.71 |
| 3,728,217 | 4/1973 | Dandl | 176/3 |
| 3,746,860 | 7/1973 | Shatas et al. | 250/402 |
| 3,752,989 | 8/1973 | Motz et al. | 250/401 |
| 3,961,197 | 6/1976 | Dawson | 378/119 |
| 3,969,628 | 7/1976 | Roberts et al. | 250/402 |
| 4,293,794 | 10/1981 | Kapetanakos | 315/111.41 |

OTHER PUBLICATIONS

N. A. Uckan et al., *Physics of Hot Electron Rings in EBT: Theory and Experiment,* ORNL/TM-7585, NTIS, 1981, pp. 1-4.

A. Simon, *An Introduction to Thermonuclear Research,* N.Y., Pergamon Press, 1959, pp. 35-39.

R. S. Dike et al., "Development of an Interleaved Fractional Turn Coil," *Proc. of 1965 Symposium on Eng. Problems of Thermonuclear Res. Conf.,* 650512, T1D 4500, 43rd ed.

*Primary Examiner*—Alfred E. Smith

*Assistant Examiner*—T. N. Grigsby

*Attorney, Agent, or Firm*—Fitch, Even, Tabin & Flannery

[57] ABSTRACT

An x-ray burst generator confines a hot plasma ring in an ELMO magnetic mirror configuration. A high Z target, such as tungsten, is retained adjacent to, but outside of the hot plasma ring. A short duration pulse is applied to the confining field so that the plasma ring is completely intersected by the target in a time short compared with the time t for an electron to precess once around the ring. The target then intercepts the circulating electrons which generate a burst of x-rays as they strike the target. The burst duration is then approximately t.

32 Claims, 10 Drawing Figures

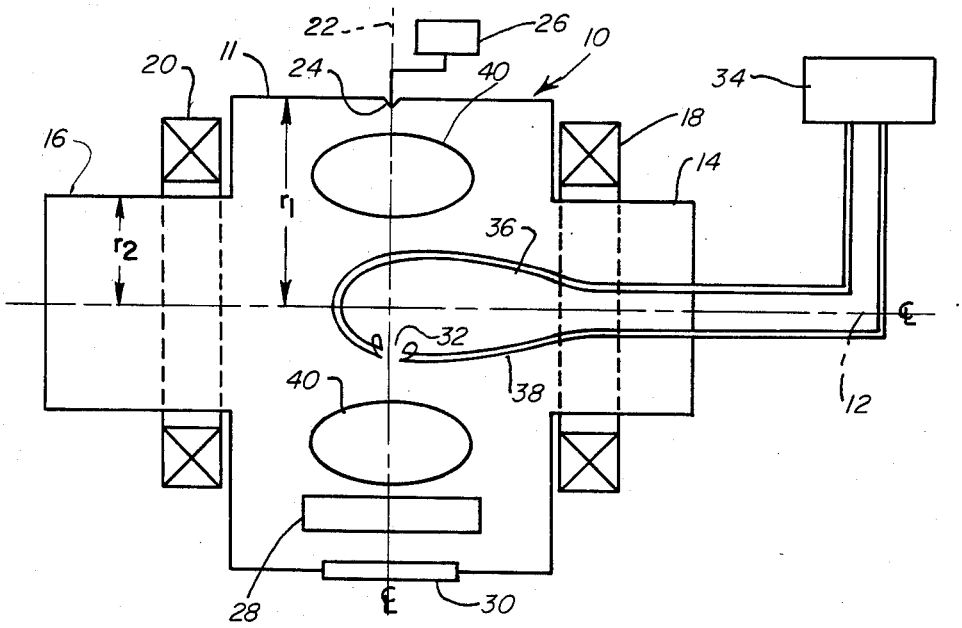
FIG. 1
FIG. 2(a)
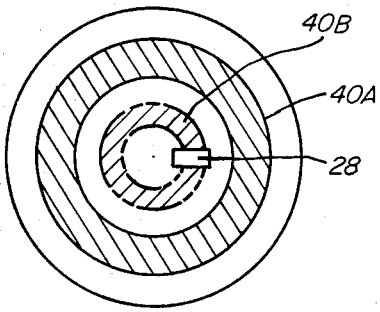
FIG. 2(b)
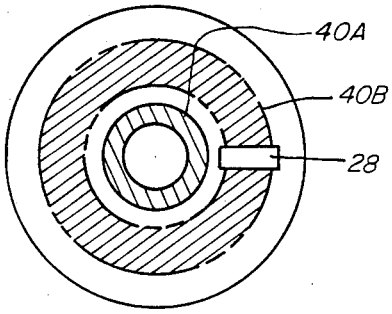
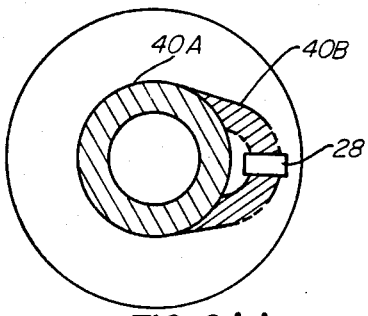
FIG. 2(c)
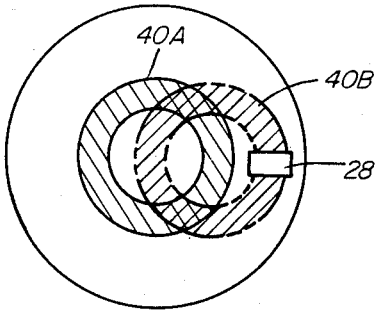
FIG. 2(d)

APPARATUS AND METHOD FOR PLASMA GENERATION OF X-RAY BURSTS

This invention relates generally to the production of x-rays by a hot plasma. More particularly, it relates to apparatus and methods capable of generating intense sub-microsecond x-ray bursts, or pulses, by a hot, trapped plasma.

BACKGROUND OF THE INVENTION

Sources of intense, sub-microsecond x-ray pulses are required for testing the response of components and materials to pulsed fusion reactions. Desired pulse widths for such testing range from the order of 10 ns to several ms. Desired x-ray spectra peak in the range of about 1 to 5 MeV. Desired dose rates may range from $10^{10}$ to $10^{13}$ rads/sec. It is also desirable that the x-ray sources be transportable.

At the present time Blumlien driven diodes are used for high intensity ns pulsed x-ray sources. Such sources produce x-ray bursts which are of the order of 100 ns long. This is a factor of about 5 longer than the shortest burst desirable for such testing. Furthermore, Blumlien driven diodes have slow repetition rates, limited transportability, high cost, and poor reliability There have been proposals to make use of hot plasmas for the generation of x-rays as in R.A. Shatas, et al., U.S. Pat. No. 3,746,860, issued July 17, 1973 for Soft X-Ray Generator Assisted by Laser, and T.G. Roberts, et al., U.S. Pat. No. 3,969,628, issued July 13, 1976 for Intense Energetic Electron Assisted X-Ray Generator. These proposals use short-lived, hot, dense plasmas to generate x-ray pulses which may have time durations ranging from 100 ns to 1 ms. Desirably short x-ray pulses are not, however, obtainable with the Shatas, et al. and Roberts, et al. techniques.

It is known that one can produce relatively stable, hot plasmas of low density. Stable plasma configurations have been described by R.A. Dandl, U.S. Pat. No. 3,728,217, issued Aug. 17, 1973 for Bumpy Torus Plasma Confinement Device. Dandl describes a so-called ELMO Bumpy Torus with hot annular plasma rings, or annuli, surrounding the toroidal axis and symmetrically located with respect to the mid-plane of the torus. The electron temperature within the annulus may be raised to a few MeV in hydrogen plasmas having number densities of the order of $10^{12}$ -$10^{14}$ atoms/cc. The hot plasma ring is kept from spreading in the direction along the toroidal axis by a magnetic mirror formed from an inhomogeneous magnetic field within the torus. It is known that the trapping effect of the inhomogeneous field is enhanced by local currents generated in the surrounding plasma, making low density plasmas quite stable. The hot electrons circulate around the ring with drift velocities of the order of 0.1c,c being the speed of light. Thus, if the hot plasma ring has a circumference of the order of 30 cm, an electron circulates around the ring in a time of the order of 10 ns.

SUMMARY OF THE INVENTION

The rapid insertion of a suitable x-ray target into a hot electron plasma would result in an x-ray burst having a pulse length of order of the circulation time. One aspect of the present invention is accordingly directed to utilization of the hot electrons in a hot plasma ring trapped in a mirror magnetic field for the generation of short, intense x-ray pulses. The duration of an x-ray pulse will be approximately equal to the time for an electron to circulate around the circumference of the plasma ring.

Because it is sometimes desirable to have an x-ray pulse with very sharp rise and fall times it would not always be feasible to move a target into the plasma ring because of the relatively great inertia of the target. Accordingly, in accordance with one embodiment of the present invention the plasma is preferably moved to the target. In one such embodiment incorporating principles of the present invention a target, preferably made of a dense, high Z material such as tungsten, is located in the vicinity of a hot plasma ring. As the hot plasma ring is formed and heated, it is magnetically isolated from the target. When an x-ray burst is desired, the magnetic field confining the plasma is modified to move the plasma so as to cause the plasma to be substantially completely intersected by the target. The target will then intercept the circulating electrons in the plasma causing a resultant x-ray pulse. The hot plasma ring functions to carry the hot electrons in circular paths until they strike the target.

An embodiment exemplifying principles of the present invention may, therefore, be an x-ray burst generator comprising target means, plasma means and diverter means. The target means retains a high Z target such as a tungsten block in a target location. The plasma means produces a magnetically confined ring plasma, similar to that in an ELMO device with the ring plasma electrons heated to a desired temperature in excess of about 1 MeV. The ring plasma is maintained in a position which is proximate to, but magnetically separated from, the target means. The diverter means brings the ring plasma electrons into contact with the high Z target. The collisions between the ring plasma electrons and the target then generate an x-ray pulse. The action of the diverter means may be made very rapid so that the ring plasma electron paths are substantially fully intercepted by the target in a time period that is short compared with the mean electron circulation time. The pulse duration will then be approximately equal to the circulation time.

Accordingly, it is an object of the present invention to provide an improved apparatus and method for producing sub-microsecond x-ray pulses.

Other objects and advantages will become apparent in the following detailed description, particularly when taken in conjunction with the accompanying drawings.

DESCRIPTION OF THE DRAWINGS

FIG. 1 is a partly diagrammatic representation of an axial cross section of an x-ray pulse generator exemplifying an embodiment of the present invention.

FIG. 2 diagrammatically illustrates four ways of shifting a plasma ring onto a target in an x-ray generator embodying principles of the present invention: (a) magnetic compression, (b) magnetic expansion, (c) local perturbation (as by apparatus exemplified in FIG. 1), and (d) plasma shift.

DETAILED DESCRIPTION

Figure 3:
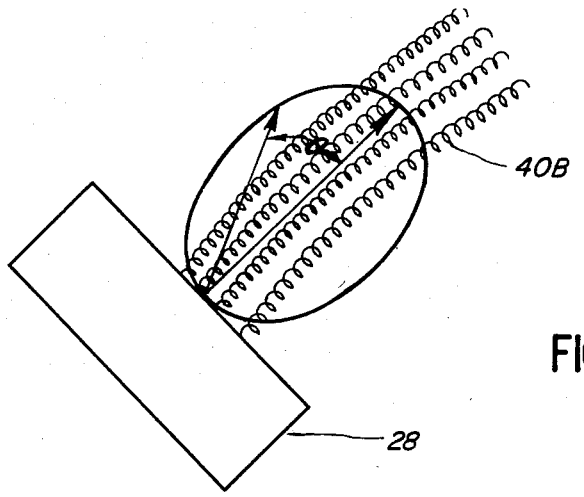
FIG. 3 diagrammatically illustrates x-ray generation by electrons striking a target as in the x ray generator of FIG. 1.

As illustrated in FIG. 1, a pulse generator may comprise generally a cylindrically symmetric vacuum chamber 10 suitable for confining a gas such as $H_2$ having a number density $n_O$ within about an order of magnitude of $10^{14}$ atoms/cc. A central portion 11 of the chamber may have a first radius $r_1$ from a center line 12 which is the axis of cylindrical symmetry. The two end portions 14, 16 of the chamber may have a second radius $r_2$ from the center line 12, $r_2$ being less than $r_1$. A pair of magnets 18, 20 carrying currents in an azimuthal direction about the center line 12 surround, respectively, the end sections 14, 16 adjacent to the central portion 11 of the chamber 10. The magnets 18, 20, therefore, define planes substantially perpendicular to the axis of symmetry 12 in which the magnet currents circulate. The magnets thereby give rise to a mirror configuration magnetic field having a minimum along a center plane 22 which is perpendicular to the symmetry axis 12 and which divides the central portion 11 of the chamber 10 into two substantially equal regions. The arrangement is generally similar to that described in connection with FIG. 1 of the Dandl patent which is included herein by reference.

A terminal 24 for RF heating of the gas in the chamber is provided at the periphery of the central region approximately on the center plane 22. The terminal is connected to a source of RF power 26. A target 28 may be retained near the periphery of the central section 11 of the chamber 10 and may be located approximately opposite the RF source 24.

The chamber 10 may contain a beryllium window 30 located with respect to the target 28 to permit the ready passage of x-rays out of the chamber 10. The location of the target 28 in the chamber 10 is important and will generally be different in different constructions of the described embodiment. The chamber 10 and the beryllium window 30 operate to collimate the x-rays from the target 28.

In the embodiment illustrated herein a pair of fractional turn coils comprising a coil 32 for generating a magnetic pulse may be placed in the central section of the chamber 10 with its axis approximately parallel to the mid-plane 22. The coil 32 is preferably not disposed on the center line 12 but is instead preferably placed between the center line 12 and the target 28. The coil 32 is connected to a pulsed power source 34. Wires 36, 38 connecting the coil 32 to the pulsed power source are arranged to follow substantially the magnetic field lines in the chamber 10. The wires 36, 38 will, therefore, not be subjected to large mechanical forces.

The magnets 18 and 20, which are preferably superconducting, are used to generate a magnetic mirror field which typically will have a 2:1 mirror ratio. With the mirror field on, RF power is supplied from the power source 26 to the terminal 24 to heat the plasma. It is well known from ELMO experiments that a hot plasma ring 40 will be formed around the symmetry axis 12 and will be approximately symmetrically located with respect to the mid-plane 22. The ring will be magnetically confined, at approximately the position shown, by the mirror field generated by the magnets 18 and 20, as described, cribed, e.g., in N.A. Uckan, et al., Physics of Hot Electron Rings in EBT: Theory and Experiment, ORNL/TM-7585, NTIS, 1981, pp. 1–4.

The electrons in the plasma ring will drift, or circulate, around the ring as described, e.g., in A. Simon, *An Introduction to Thermonuclear Research*, N.Y., Pergamon Press, 1959, pp. 35–39. The drift velocity $V_d$ resulting from the field inhomogeneity is given by $$\vec{V}_d \simeq -W_p \nabla \vec{B} \times \vec{B}/(eB^3) \quad (1a)$$

where the magnetic field $\vec{B}$ is assumed to be approximately unidirectional, e is the electron charge and $W_p$ the electron kinetic energy transverse to the field. In the case of the mirror geometry of FIG. 1, Eq. 1a reduces to $$V_d \simeq -W_p/(eBr) \quad (1b)$$

where r is the radius from the center line 12 to the average drift orbit in the plasma ring 40.

In one desirable geometry electrons will be heated to a temperature in excess of about 1 MeV. Typically they will circulate around the ring with a velocity which will be of the order of 0.1c, that is, approximately $10^9$ cm/sec. Accordingly, if the plasma ring has a circumference of approximately 30 cm then the circulation time for an electron to travel around the ring will be approximately 30 ns.

In the apparatus shown in FIG. 1 a suitably directed current pulse in the central magnet 32 will temporarily force the magnetic field lines near the target 28 from the magnets 18, 20 in an outward direction, moving the field lines away from the symmetry axis 12. The field lines will carry the plasma ring 40 with them, because the highly conductive plasma is "tied" to the field lines, causing it to move onto the target 28. Motion of the part of the plasma near the target is preferentially obtained by placing the coil 32 between the symmetry axis 12 and the target 28.

When the target 28 is in the plasma it will intercept the paths of the ring electrons. The ring electrons will then strike the target during their circulation around the ring and generate x-rays, as described generally in, for example, F.K. Richtmeyer and E.N. Kennard, *Introduction to Modern Physics*, N.Y., McGraw-Hill, 1947, pp. 495–501. If the time required for the plasma to be fully intersected by the target is very short compared with the circulation time for an electron to travel one circuit of the ring then substantially all of the ring electrons will be collected on the target in approximately the circulation time. The resulting x-ray pulse, illustrated in FIGS. 3 and 4, will then have a duration of about one circulation time, or approximately 30 ns for a 30 cm circumference ring. The beryllium window 30 will permit the x-rays to escape from the chamber in an approximately defined direction thereby giving rise to the desired x-ray pulse outside of the chamber.

Accordingly, it may be seen that an x-ray burst generator exemplifying the principles of the present invention may comprise:

a high Z target disposed in a target location;

plasma means for producing and magnetically confining a ring plasma including plasma electrons heated to a mean temperature in excess of about 1 MeV with a portion of the confined ring plasma being proximate to and magnetically separated from the target location; and diverter means for shifting the ring plasma electrons onto the high Z target to produce a burst of x-rays.

Furthermore, a method for producing a burst of x-rays in keeping with the principles of the present invention may comprise the steps of:

magnetically confining a ring plasma having plasma electrons with a mean electron temperature in excess of about 1 MeV with the ring plasma being magnetically separated from an adjacent high Z target; and bringing the plasma electrons and the target into contact to produce a burst of x-rays.

A desirably sharp-edged pulse may be obtained in the described embodiment by making the rise time of the pulse less than about 10 ns. This requirement means that the plasma must be substantially completely intersected by the target 28 during about that length of time. If the plasma ring 40 has a thickness in the radial direction from the symmetry axis 12 of about 6 cm, then the plasma must move onto the target 28 with a velocity of about $10^9$ cm/sec. This velocity must be small compared with the Alfven velocity $V_a$ of the plasma which is given by:

$$V_a = B/(\mu_o \Delta)^{\frac{1}{2}} \quad (2)$$

where $\rho$ is the mass density and $\mu_o$ the permeability of free space. Assuming as an example that the number density in the hot plasma ring is of the order of $10^{12}$ to $10^{13}$ atoms/cc for a hydrogen plasma, which is reasonable, a magnetic field at the annulus of about 1.6 T will give a resulting Alfven velocity in the range of $4\text{–}12 \times 10^9$ cm/sec. Thus, the rise time of the x-ray pulse will be sufficiently rapid for the stated range of parameters.

The rise time evidently depends directly on the time rate of change of the perturbing magnetic field. The magnetic field perturbation required to move the beam onto the target is of the order of 2 T in a time less than about 10 ns. Thus, the required rate of rise of the magnetic field, dB/dt, is about 0.2 T/nsec. This requirement places rather stringent, but manageable, requirements on the driving circuit of the perturbing magnetic field. The required current rise is about $8 \times 10^{12}$ A/sec, assuming a single turn coil with a pitch s about 5 cm and radius a of 5 cm, and according to the relationship $$dI/dt = (s/\mu_o)(dB/dt) \quad (3)$$

In a circuit having a capacitor discharging into the coil the inductance L of the coil would be given by $$L = V_o/(dI/dt)_o \quad (4)$$

where $V_o$ is the initial voltage on the capacitor, and $(dI/dt)_o$ is the initial rate of current rise. The resultant value of L is 12.6 nH, for $V_o$ about 100 kV.

The inductance L of a coil is $$L = (k\mu_o \pi N^2 a^2)/s \quad (5)$$

where k is a geometrical factor, which may be reasonably assumed to be 0.5, and N is the number of turns. For a single turn coil the resulting inductance is about 100 nH, one order of magnitude too large. Interleaved coils with fractional turns giving reduced coil inductance are, however, known. See R.S. Dike, et al., "Development of an Interleaved, Fractional-Turn Coil," *Proc. of* 1965 *Symposium on Engineering Problems of Thermonuclear Research Conf.*, 650512, TID4500, 43d Ed. Thus, use of a known quarter turn design would give 1/16 the inductance of a one turn coil with the same length or about 6.25 nH, which is sufficiently small.

The pulse duration of x-ray emission from a single module is continuously variable from the few ns range to several ms, simply by varying the magnetic field strength. The temporal versatility can be understood by recalling that the pulse length is determined by the time $t_d$ it takes for an electron to precess, or circulate, once about the magnetic axis. The time is given by $$t_d = 2\pi r^2 eB/W_p \quad (6)$$

Thus, the pulse duration $t_d$ scales as $r^2$.

The average precession radius r is just the major radius of the hot plasma ring 40. The ring location in the chamber 10 is determined by the location of the second harmonic electron cyclotron resonance frequency with respect to the frequency of the RF power source used to heat the plasma. The cyclotron resonance frequency $\omega_c$ is related to the magnetic field by $$\omega_c = Be/m \quad (7)$$

where e/m is the charge to mass ratio for an electron.

As the current in the magnet coils 18, 20 is increased, the radial location of the 2nd harmonic zone moves outward. Correspondingly, the plasma ring 40 major radius also increases. Thus a continuously variable pulse duration may be obtained by use of coils 18, 20 capable of producing, for example, a magnetic field intensity of 1.6 T at a radius of 70 cm in the mid-plane, the RF frequency being 90 GHz in the example. A 70 cm plasma ring 40 will correspondingly be formed. Then as the coil current is reduced, the location of the plasma ring 40 will move inward toward the axis of the mirror machine, and the pulse duration decreases from 2.46$\mu$ at a radius of 70 cm to 24 ns at a radius of 7 cm.

Other arrangements for moving a plasma annulus onto a target than that exemplified in FIG. 1 also fall within the scope of the present invention. FIG. 2, for example, illustrates four different embodiments, each utilizing a different method for moving a plasa annulus onto a target. In each of the four FIGS. 2(*a*), 2(*b*), 2(*c*) and 2(*d*) the unperturbed plasma 40A is shown in cross-section as seen, for example, along the center line from the end piece 14 in FIG. 1. The perturbed plasma 40B is shown in each of the FIGS. 2(*a*), 2(*b*), 2(*c*) and 2(*d*) as the hot electrons are diverted onto the target 28. FIG. 2(*a*) illustrates magnetic compression wherein the unperturbed ring 40 1s squeezed to a reduced diameter ring 40B onto the target 28, which is placed inside the unperturbed plasma ring 40A. FIG. 2(*b*) illustrates magnetic expansion of a plasma ring wherein the unperturbed plasma ring 40A is expanded to an increased diameter ring 40B onto the target 28, which is placed outside the unperturbed plasma ring 40A. Squeezing or expansion may be accomplished by respectively increasing or decreasing the strength of the mirror field generated by the magnets 18, 20. FIG. 2(*c*) illustrates local expansion of an unperturbed plasma ring 40A onto the target 28. Local contraction onto a target inside the ring 40A would also be in keeping with the embodiment shown in FIG. 2(*c*). FIG. 2(*d*) illustrates plasma shift of a plasma ring wherein the entire ring is shifted to intercept a target 28 which initially may be inside or outside of the unperturbed plasma ring 40A. Local expansion or plasma shift may be accomplished by distorting the mirror magnetic field, as is done in the embodiment exemplified in FIG. 1.

FIG. 3 illustrates more specifically the focusing property of a generated x-ray beam in accordance with the inherent capability of the disclosed device to direct a photon flux by the orientation of the target. The directional distribution of the intensity of x-rays generated by an electron beam 40B impacting a high Z target 28 may be approximated by a $\cos^2\theta$dependence. Here $\theta$ is the angle formed between the normal to the surface and the direction of an x-ray quantum. The maximum of the intensity distribution occurs along the normal to the surface. Therefore the x-rays may be aimed by orienting the surface of the target with its normal in the desired direction, as shown in FIG. 3. The axial symmetry of the ring allows the location of the target at any desirable point along the circumference of the annulus.

Figure 4:
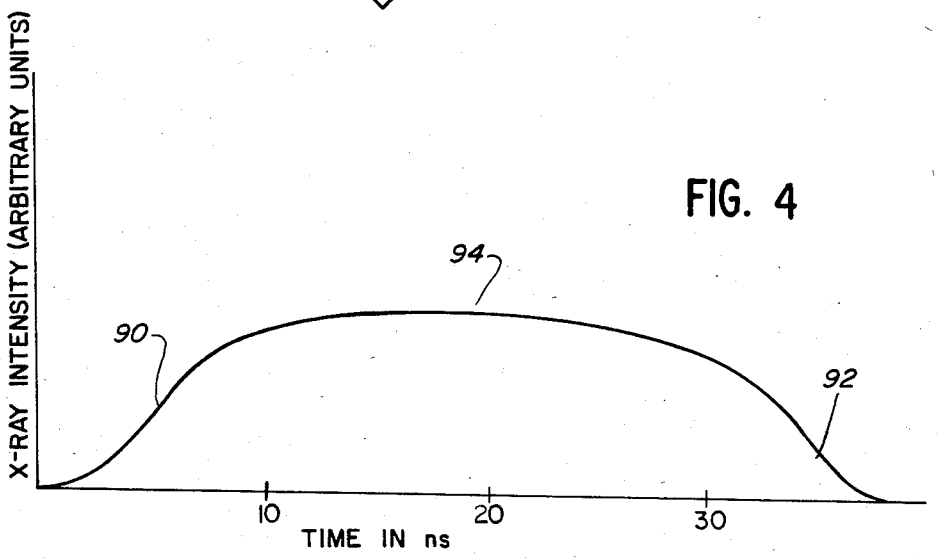
FIG. 4 illustrates qualitatively the shape of a fast rise time x-ray pulse that may be generated by a specific construction of the x-ray generator of FIG. 1.

FIG. 4 illustrates qualitatively the shape of a sharp-edged pulse resulting from a plasma ring having a circulation time of about 30 ns. The rise time 90, corresponding to the time the plasma ring 40 is diverted onto the target 28, is about 10 ns. Similarly, a fall time 92 resulting from the plasma ring electron velocity distribution as well as the distribution of circulation times of electrons missing the target during diversion is also expected to be about 10 ns. Between about 10 ns and 20 ns after diversion is a flat-top interval 94.

Figure 6:
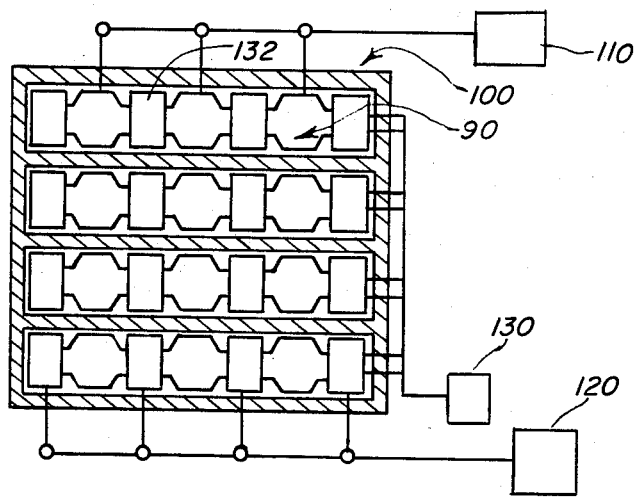
FIG. 6 illustrates a cluster using modules such as is illustrated in FIG. 5.
Figure 5:
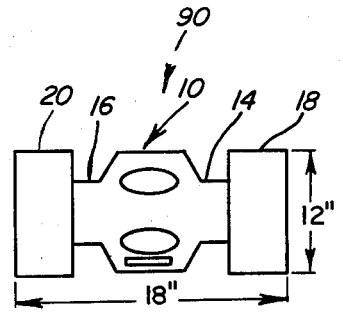
FIG. 5 illustrates a single module built in accordance with the principles illustrated in FIG. 1.

The relatively small size of the chamber 10 provides a large systems capability. FIG. 5 illustrates the approximate dimensions of a single module 90 which is about the size of the original ELMO device. The stored energy in this size module with a magnetic field of 1.6 T at the annulus is 4.6 kJ, assuming an annulus $\beta$ of 50% and scaling directly from the ELMO parameters. A cluster 100 of 12 modules 90 of this size arranged in the configuration shown in FIG. 6 would have a total stored energy of 55.2 kJ in an area of roughly 29 sq. ft. (2.69 $m^2$). This cluster 100 configuration affords a distributed source of x-rays which can be useful in simulating a plane wave of radiation. Furthermore, this cluster 100 unit is a convenient size for transporting several such clusters in conventional vehicles to remote sites. The individual modules 90 in the cluster 100 are operably connected to an RF source 110, a refrigeration and power source 120 and a diverter source 130 for simultaneous operation. Furthermore, adjacent modules may share magnets 18, 20 of FIG. 1, as exemplified by the magnet 132 of FIG. 6.

Figure 7:
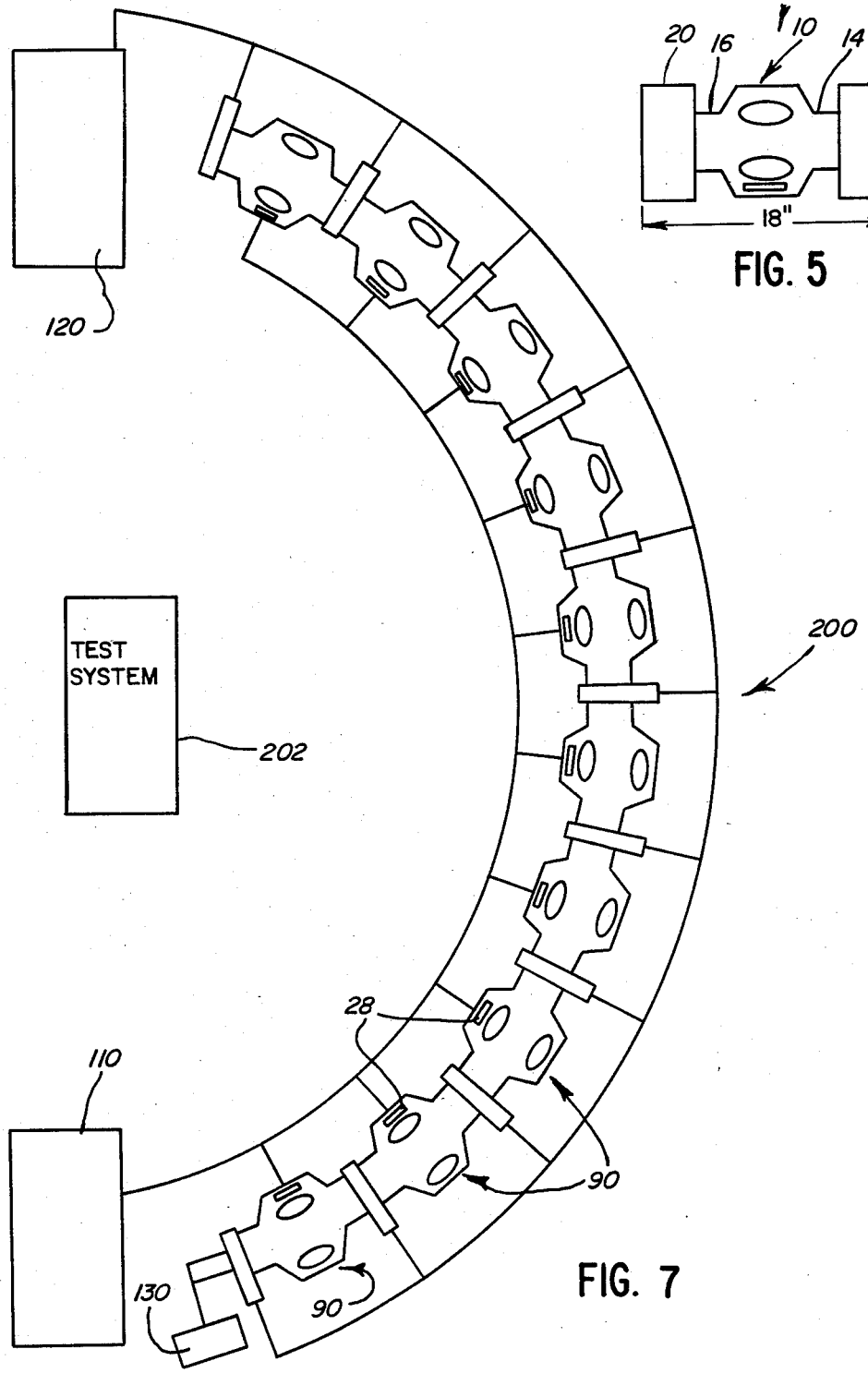
FIG. 7 illustrates a configuration of x-ray modules such as is illustrated in FIG. 5 arranged to provide geometrical focusing.

The directionality and aiming property of a module 90 provides a means for geometrically focusing the x-ray radiation into a converging pattern. FIG. 7 exemplifies a pattern 200 of operatively linked modules 90 arranged along an arc in such a manner that the normals to the target surfaces are aimed at the system 202 undergoing test. In effect, this configuration provides a geometrical focusing of the x-rays onto the test specimen, and aids in reducing the inverse square losses incurred in locating the sources remotely from the test specimen.

It will of course be understood that modification of the present invention and its various aspects will be apparent to those skilled in the art, some being apparent only after study and others being a matter of routine design. For example, the described embodiment makes specific use of the ELMO geometry for producing a ring plasma. However, other geometries which would result in a heated ring plasma would also fall within the scope of the present invention. Furthermore, the present invention makes specific use of RF heating to heat the plasma. Other means of providing energy to a plasma ring would however also fall within the scope of the present invention. Additionally, it should be noted that the rapid rates of rise of x-ray pulses generated by the described embodiment are not a necessary feature of the present invention. Other embodiments that move a plasma ring onto a target in a time comparable to or greater than the time for an electron to circulate around a plasma ring are also included within the scope of the invention. It is to be appreciated therefore that the scope of the invention should not be limited by the particular embodiment and its specific construction herein described, but should be defined only by the appended claims and equivalents thereof.

What is claimed is:

1. An x-ray burst generator comprising:

target means for retaining a high Z target in a target location;

plasma means for producing and magnetically confining a ring plasma, including plasma electrons heated to a mean temperature in excess of about 1 MeV, with a portion of said confined ring plasma being proximate to and magnetically separated from said target; and diverter means for bringing said ring plasma electrons into contact with a high Z target disposed at said target location to produce a burst of x-rays.

2. An x-ray burst generator according to claim 1 wherein said diverter means brings said ring plasma into contact with said target to produce said burst of x-rays occurs over a time approximately equal to the time for said ring plasma electrons to circulate once around said ring plasma.

3. An x-ray burst generator according to claim 2 wherein said diverter means produces said burst of x-rays with a flat top.

4. An x-ray burst generator according to any of claims 1 through 3 wherein said plasma means includes an ELMO configuration.

5. An x-ray burst generator according to any of claims 1 through 3 wherein said plasma means includes superconducting magnets for magnetically confining said ring plasma.

6. An x-ray burst generator according to any of claims 1 through 3 wherein said plasma means includes means for RF heating of said ring plasma.

7. An x-ray burst generator according to any of claims 1 through 3 wherein said plasma means includes confinement means defining a chamber for confining a low density gas in which said ring plasma is magnetically confined.

8. An x-ray burst generator according to claim 7 wherein said chamber is axially symmetric.

9. An x-ray burst generator according to claim 7 wherein said chamber confines $H_2$ having a number density within about an order of magnitude of $10^{14}$ atoms/ per cc.

10. An x-ray burst generator according to claim 7 wherein said confinement means provides a chamber having a window for collimating said burst of x-rays.

11. An x-ray burst generator according to claim 1 wherein said diverter means is operable to shift said ring plasma onto said high Z target.

12. An x-ray burst generator according to claim 1 including a tungsten target retained in said target location by said target means.

13. A method for producing a burst of x-rays comprising the steps of:

magnetically confining a ring plasma having a mean electron temperature in excess of about 1 MeV, said plasma being magnetically separated from an adjacent high Z target and said ring plasma containing plasma electrons circulating around said ring plasma with a circulation time t; and bringing said plasma electrons and said target into contact.

14. A method for producing a burst of x-rays according to claim 13 wherein said step of bringing said plasma electrons and said target into contact causes said target to intersect said ring plasma substantially completely within a time interval of the order of time t.

15. A method for producing a burst of x-rays according to claim 13 wherein said step of bringing said plasma electrons and said target in contact causes said target to intersect said ring plasma substantially completely within a time interval short relative to t.

16. A method for producing a burst of x-rays according to claim 15 further characterized in that said plasma electrons are brought into contact with said target so that said target substantially completely intersects said plasma ring in a time interval less than about t/3 to produce a flat-topped x-ray pulse.

17. A method for producing a burst of x-rays according to claim 13 wherein said step of magnetically confining a plasma ring includes the step of heating said plasma ring by application of RF power in accordance with the ELMO concept.

18. A method for producing a burst of x-rays according to claim 13 wherein said mean electron temperature is about 2 MeV.

19. Apparatus for directing relativistic electrons onto a target comprising:

means for magnetically containing a plasma ring having plasma electrons with a mean electron temperature in excess of about 1 MeV within a cold background plasma;

means for retaining the target in proximity to said plasma ring;

means for moving said plasma ring with a velocity within about one order of magnitude of said background plasma Alfven velocity onto the target to cause substantially all of said plasma electrons to collide with said target during a time interval comparable to the time for said plasma electrons to circulate around said ring plasma.

20. An apparatus according to claim 19, wherein said means for moving said plasma ring includes a nanohenry inductance coil.

21. An apparatus according to claim 19, including means for energizing said nanohenry inductance coil.

22. An apparatus according to claim 20 wherein said nanohenry inductance coil is contained within said means for magnetically containing a plasma ring and said means for energizing said coil includes leads oriented substantially parallel to the magnetically confining magnetic field lines.

23. An apparatus according to claim 19 wherein said background plasma is further characterized by an Alfven velocity at least as great as about 1/10 the velocity of light in vacuo.

24. A method for diverting the circulating electron component of a plasma ring, confined by a mirror magnetic field and having a circulation time t, onto an adjacent target, said method comprising the step of varying the confining magnetic field to cause the target to intercept the paths of substantially all of the plasma electrons in a time interval less than about t/3.

25. In an x-ray burst generator for producing intense x-ray bursts having rise times of order of magnitude of 10 ns and flat-top times greater than about 1 ns, a method for varying the flat-top times comprising the steps of:

mirror trapping a plasma ring having mean electron energy greater than about 1 MeV in the vicinity of a target suitable for x-ray production, the plasma being movable onto said target to produce an x-ray burst, and changing the mirror trapping field to vary the flat-top time.

26. In an x-ray burst generator having a hot mirror-trapped plasma ring and a fixed target in the vicinity of and magnetically isolated from the plasma ring, an apparatus for diverting the plasma ring onto the target comprising:

energizing means for energizing an inductance, and nanohenry inductance means for generating a diverting magnetic field having a rise time less than about 10 ns connectable to said energizing means and located to vary the position of at least part of the plasma ring to cause the plasma ring to position itself on the target within approximately the time for said plasma electrons to circulate once around said plasma ring after said inductance means is connected to said energizing means.

27. A method for producing a burst of x-rays comprising the steps of:

magnetically confining a ring plasma having a mean electron temperature in excess of about 1 MeV, said plasma being magnetically separated from an adjacent high Z target and said plasma ring containing electrons circulating around said ring plasma with a circulation time t; and diverting said plasma electrons into contact with said target.

28. A method for producing a burst of x-rays according to claim 27 wherein said step of diverting said plasma electrons into contact with said target causes said target to intersect said ring plasma substantially completely during a time interval of the order of t.

29. A method for producing a burst of x-rays according to claim 27 wherein said step of diverting said plasma electrons into contact with said target causes said target to intersect said ring plasma substantially completely within a time interval short relative to t.

30. A method for producing a burst of x-rays according to claim 29 further characterized in that said plasma electrons are diverted into contact with said target so that said target completely intersects said plasma ring in a time interval less than about t/3 to produce a flat-topped x ray pulse.

31. A method for producing a burst of x-rays according to claim 27 wherein said step of magnetically confining a plasma ring includes the step of heating said plasma ring by application of RF power in accordance with the ELMO concept.

32. A method for producing a burst of x-rays according to claim 27 wherein said mean electron temperature is about 2 MeV.

* * * * *

UNITED STATES PATENT AND TRADEMARK OFFICE

CERTIFICATE OF CORRECTION

PATENT NO. : 4,553,256

DATED : November 12, 1985

INVENTOR(S) : Kenneth G. Moses

It is certified that error appears in the above-identified patent and that said Letters Patent is hereby corrected as shown below:

Abstract page, in the reference to R. S. Dike, et al., change "T1D" to --TID--.

Column 1, line 26, after "reliability" insert a period.

Column 3, line 68, delete "cribed,".

Column 5, line 22, change "Δ" to --ρ-- in Equation 2.

Column 6, line 30, change "2.46μ" to --2.46μs--.

Column 6, line 44, change "1s" to --is--.

Column 7, line 2, insert a space after "$\cos^2\theta$".

Column 9, line 44, after "19" delete the comma.

Column 9, line 47, change "19," to --20--.

Column 9, line 49, change "20" to --21--.

Signed and Sealed this

Tenth Day of June 1986

[SEAL]

Attest:

DONALD J. QUIGG

Attesting Officer

Commissioner of Patents and Trademarks